US005825272A

United States Patent [19]

Yamada et al.

[11] Patent Number: 5,825,272

[45] Date of Patent: Oct. 20, 1998

[54] CHOKE COIL FOR SUPPRESSING COMMON-MODE NOISE AND NORMAL-MODE NOISE

[75] Inventors: Tatsuyuki Yamada; Kouichi Yamaguchi, both of Fukui-ken; Takaaki Ooi, Takefu, all of Japan

[73] Assignee: Murata Manufacturing Co., Ltd., Nagaokakyo, Japan

[21] Appl. No.: 867,735

[22] Filed: Jun. 3, 1997

[30] Foreign Application Priority Data

Jun. 10, 1996 [JP] Japan ..... 8-147265

[51] Int. Cl.[6] ..... H01F 27/24

[52] U.S. Cl. ..... 336/212; 336/215; 336/233

[58] Field of Search ..... 336/83, 212, 233, 336/215, 214

[56] References Cited

U.S. PATENT DOCUMENTS 5,506,559 4/1996 Yamaguchi ..... 336/212

FOREIGN PATENT DOCUMENTS 7-106140 4/1995 Japan .

*Primary Examiner*—Thomas J. Kozma

*Attorney, Agent, or Firm*—Burns, Doane, Swecker & Mathis, LLP

[57] ABSTRACT

A choke coil is disclosed which exhibits sufficient capability in suppressing both common-mode noise and normal-mode noise with a small number of parts. A bobbin is formed of a rod and flanges provided for the rod. A pair of windings are reeled around the rod. Further, one side of a hollow-rectangular integral-type magnetic core is inserted into a hole formed in the rod of the bobbin. The heights of the flange of the bobbin are set as L2 in the upward direction, while the heights of the flange of the bobbin are determined as L1 in the downward direction (as illustrated) with L1>L2, i.e., the heights of the flange are varied in the directions along the outer peripheral surfaces of the flange.

15 Claims, 6 Drawing Sheets

Fig. 7A
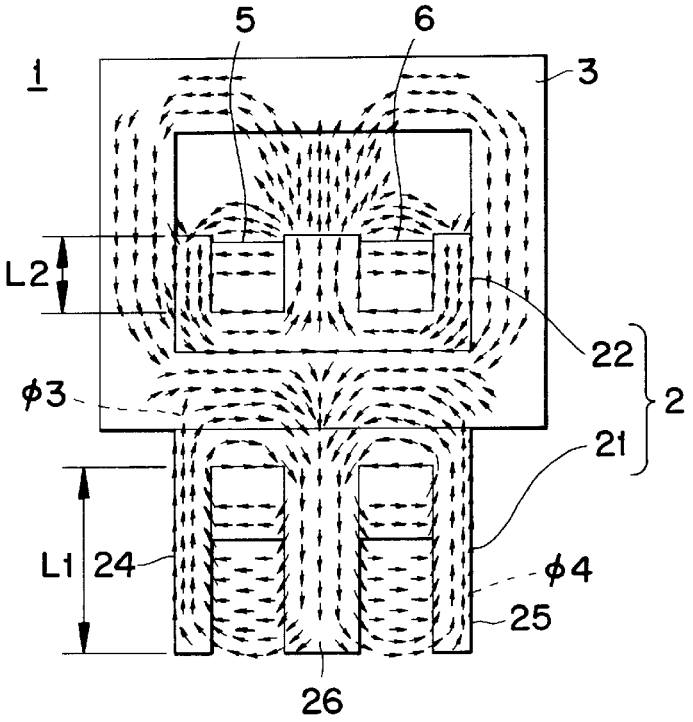
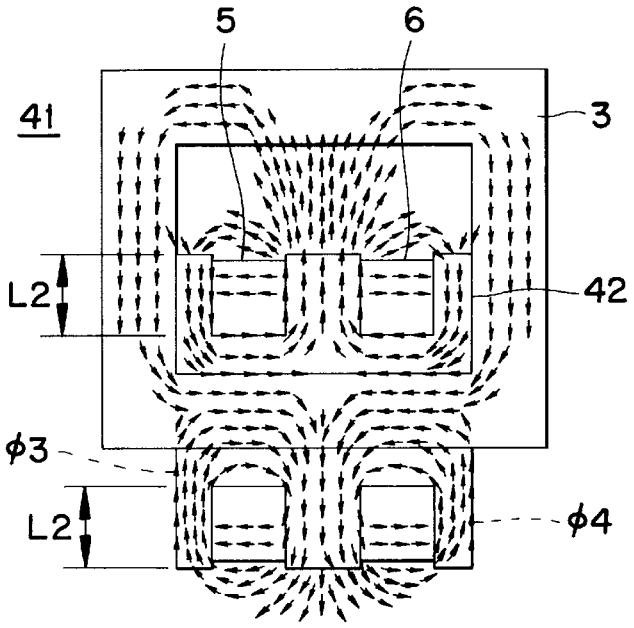
Fig. 7B
(PRIOR ART)

CHOKE COIL FOR SUPPRESSING COMMON-MODE NOISE AND NORMAL-MODE NOISE

BACKGROUND OF THE INVENTION

1. Field of the Invention

The present invention relates generally to choke coils and, more particularly, to a choke coil used for suppressing noise generated in or entering electronic equipment.

2. Description of the Related Art

Typically, since common-mode choke coils have a slight leakage inductance in its normal mode (that is, differential mode), they are effective against normal-mode noise, as well as against common-mode noise. If, however, the normal-mode noise is too high, a normal-mode choke coil has been independently used to reduce such noise.

Further, it is known that the common-mode inductance can be increased by using a magnetic-powder-mixed resin as a material for a bobbin used in the common-mode choke coil. In this case, the heights of flanges used in the bobbin are equal in radial directions as measured from the center to outer peripheral surfaces of the flanges, and are set to a minimal dimension required for ensuring the distance from one end of one winding to one end of the other winding along the exposed surface of the flange is at a minimum.

If, however, only a magnetic-powder-mixed resin is used as the material for the bobbin, the generated normal-mode magnetic flux unfavorably diverges in air, thereby failing to obtain a large normal-mode inductance component.

Aside from the above-described choke coil, for effectively suppressing both common-mode noise and normal-mode noise, the common-mode choke coil disclosed in Japanese Unexamined Patent Publication No. 7-106140 has been proposed. This common-mode choke coil is, however, constructed such that a lid member should be used in a magnetic path in which the normal-mode magnetic flux circulates. This increases the number of parts and makes the assembly operation more complicated.

SUMMARY OF THE INVENTION

Accordingly, it is an exemplary object of the present invention to provide a choke coil which has sufficient capability of suppressing both common-mode noise and normal-mode noise with a minimal number of parts.

In order to achieve the above object, there is provided a choke coil comprising: (a) a pair of windings; (b) a magnetic bobbin having a cylindrical rod and flanges extending away from said cylindrical rod about which said pair of windings are wound, the height of each of said flanges varying in radial directions wherein the height is measured from said cylindrical rod to the outer peripheral surfaces of said flanges; and (c)a magnetic core, having one side which is in a hole in said cylindrical rod, for forming a closed magnetic path.

The term "height of the flange" used herein is specified as the dimension from the surface of the cylindrical rod to the outer peripheral surface of the flange. All of the flanges may preferably be formed in the same general shape. The term "cylindrical" used herein is to be given its mathematical definition, i.e., a surface generated by a straight line moving parallel to a fixed straight line and intersection a plane curve including rectilinear curves, and not just a plane circle.

With this construction, when common-mode noise currents flow in a pair of windings, magnetic flux is generated in the windings. The magnetic flux is combined and converted into thermal energy in the form of eddy current loss while circulating in a closed magnetic path formed by the magnetic core. Accordingly, the magnetic flux is progressively attenuated. As a result, the common-mode noise currents can be reduced.

In contrast, when a normal-mode noise current flows in the pair of windings, magnetic flux is produced in the windings. The magnetic flux is converted into thermal energy in the form of eddy current loss and is accordingly attenuated while circulating in the closed magnetic path formed by the magnetic bobbin and a space between the bobbin and the forward ends of the flanges. Thus, the normal-mode noise current is reduced.

BRIEF DESCRIPTION OF THE DRAWINGS

FIGS. 5A and 5B illustrate the common-mode noise suppressing function of the choke coil shown in FIG. 1, wherein FIG. 5A is a magnetic circuit diagram and FIG. 5B is an electrical circuit diagram;

FIGS. 6A and 6B illustrate the normal-mode noise suppressing function of the choke coil shown in FIG. 1, wherein FIG. 6A is a magnetic circuit diagram and FIG. 6B is an electrical circuit diagram;

FIGS. 7A and 7B illustrate the state in which the normal-mode magnetic flux is generated, wherein FIG. 7A is a diagram illustrating the magnetic-flux distribution of the choke coil according to an embodiment of the present invention and FIG. 7B is a diagram illustrating the magnetic-flux distribution of a conventional choke coil.

DESCRIPTION OF THE PREFERRED EMBODIMENT

A description will now be given of a choke coil according to an embodiment of the present invention with reference to the accompanying drawings.

Figure 1:
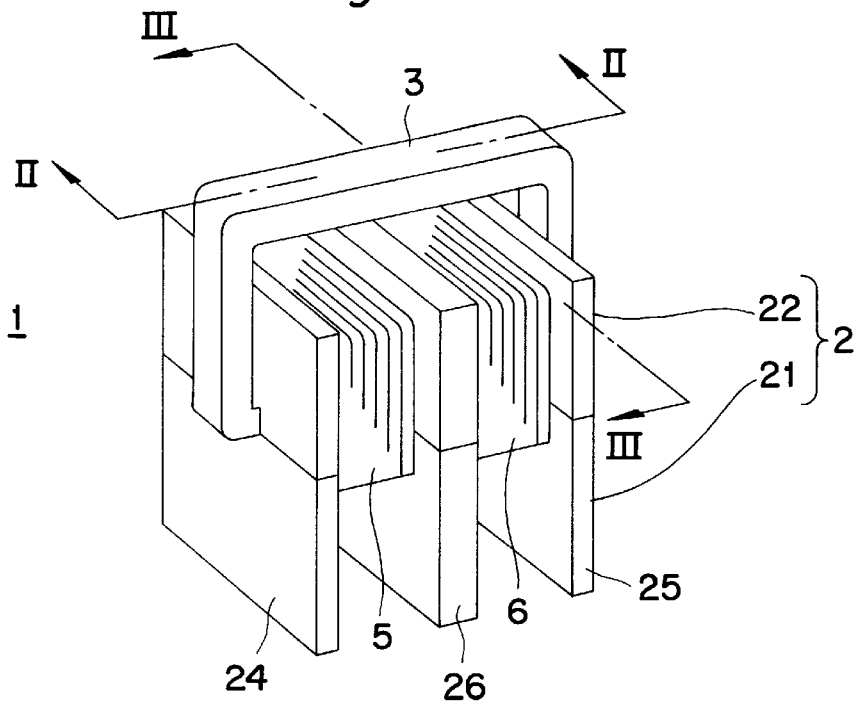
FIG. 1 is a perspective view of a choke coil according to an embodiment of the present invention.
Figure 2:
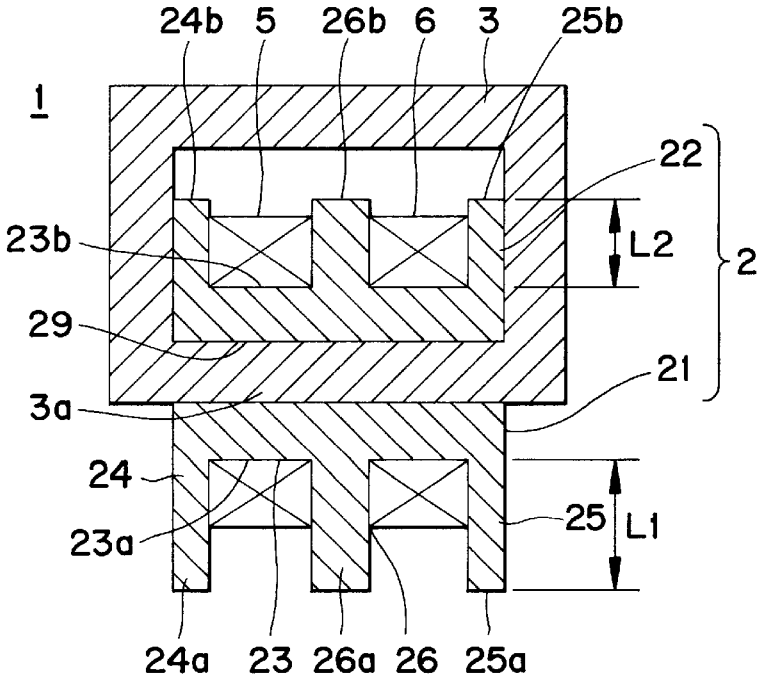
FIG. 2 is a cross-sectional view taken along line II—II of FIG. 1.
Figure 3:
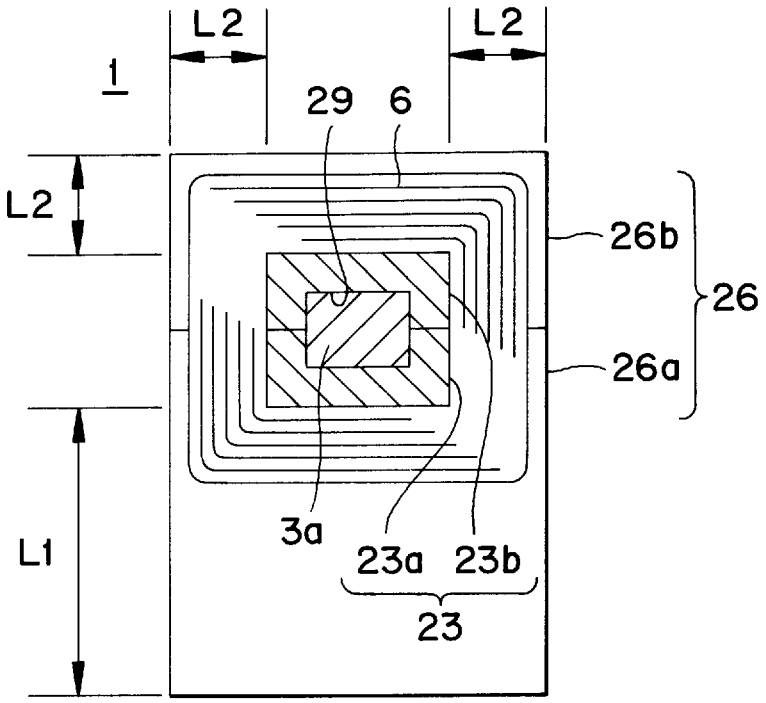
FIG. 3 is a cross-sectional view taken along line III—III of FIG. 1.

A choke coil 1 is formed, as illustrated in FIGS. 1 through 3, of a split-type bobbin 2, an integral-type magnetic core 3, and a pair of windings 5 and 6. The split-type bobbin 2 has first and second bobbin members 21 and 22 which have been split in a direction parallel to the axis of the bobbin 2. The first bobbin member 21 has a first rod-like portion 23*a* having a rectangular groove in its cross section and three rectangular-tabular flange portions 24*a*, 25*a* and 26*a*, the outer flange portions 24*a* and 25*a* being disposed at both ends of the first rod-like portion 23*a*, and the central flange portion 26*a* being provided at the center of the first rod-like portion 23*a*.

Similarly, the second bobbin member 22 includes a second rod-like portion 23*b* having a rectangular groove in its cross section and three rectangular-tabular flange portions 24*b*, 25*b* and 26*b*, the outer flange portions 24*b* and 25*b* being provided at both ends of the second rod-like portion 23*b*, and the central flange portion 26*b* being disposed at the center of the second rod-like portion 23*b*.

As a material for the bobbin members 21 and 22, a magnetic material having a relative magnetic permeability of one or greater (for example, two or several dozen (e.g., 30)) is used. More specifically, the above type of magnetic material may include a mixture made by kneading Ni-Zn or Mn-Zn ferrite powder and a resin binder, a magnetic material, such as ferrite or amorphous coated with an insulating material, and ferrite or amorphous insert-molded into an insulating resin. As the material for the integral-type magnetic core 3 formed in a hollow-rectangular shape, a magnetic material having a relative magnetic permeability of several thousands is preferably used, and more specifically, ferrite or amorphous may be employed.

The bobbin members 21 and 22 constructed as described above are fit into each other or bonded with an adhesive while clamping a side 3*a* of the magnetic core 3 between the rod-like portions 23*a* and 23*b*, thereby forming the bobbin 2. By bonding the bobbin members 21 and 22, the bobbin 2 is constructed to have a cylindrical rod 23 formed of the first and second rod-like portions 23*a* and 23*b*, and rectangle-tabular flanges 24, 25 and 26 respectively formed of the respective first and second flange portions 24*a* and 24*b*, 25*a* and 25*b*, and 26*a* and 26*b*. The outer flanges 24 and 25 are disposed at both ends of the rod 23, and the central flange 26 is provided at the center of the rod 23 in this embodiment.

All the flanges 24, 25 and 26 are formed generally in the same shape. Specifically, the height of the central flange 26 (the dimension from the surface of the rod 23 to the outer peripheral surface of the central flange 26), for example, is indicated by L2 in the upward direction (away from the rod 23) and leftward and rightward directions (directions perpendicular to the upward direction in the plane of the respective flange), and is represented by L1 in the downward direction (in a direction opposite to the upward direction) wherein L1>L2, as shown in FIGS. 1 and 3. The heights L1 and L2 of the flanges 24 through 26 are different with respect to the upward and downward directions along the peripheral surfaces of the flanges 24 through 26.

The dimension L2 is set to a minimal height required for ensuring a distance from one end of the winding 5 to one end of the winding 6 along the exposed surface of the flange 26, more specifically, from approximately 1.5 to 1.6 mm. The dimension L1 is preferably about two times as large as the dimension L2, more specifically, from approximately 3 to 4 mm.

A hole 29 formed in the cylindrical rod 23 is rectangular in cross section. This may be formed in another shape, such as a circle. The windings 5 and 6 are respectively reeled around the substantially left half and right half of the rod 23 between the flanges 24, 25 and 26.

Figure 4:
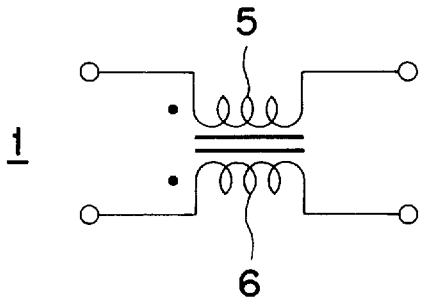
FIG. 4 is a diagram illustrating an electrical equivalent circuit of the choke coil shown in FIG. 1.

With this arrangement, the following-structured choke coil 1 can be obtained. In the region surrounded by the magnetic core 3, the forward ends of the flanges 24 through 26, more particularly, the flange portions 24*a* through 26*a* of the first bobbin member 22, slightly protrude from the outer peripheral surfaces of the windings 5 and 6. In contrast, outside the region surrounded by the magnetic core 3, the forward ends of the flanges 24 through 26, more particularly, the flange portions 24*b* through 26*b* of the second bobbin member 23, protrude considerably from the outer peripheral surfaces of the windings 5 and 6. FIG. 4 is a diagram of an electrical equivalent circuit of the choke coil 1.

Figure 5A:
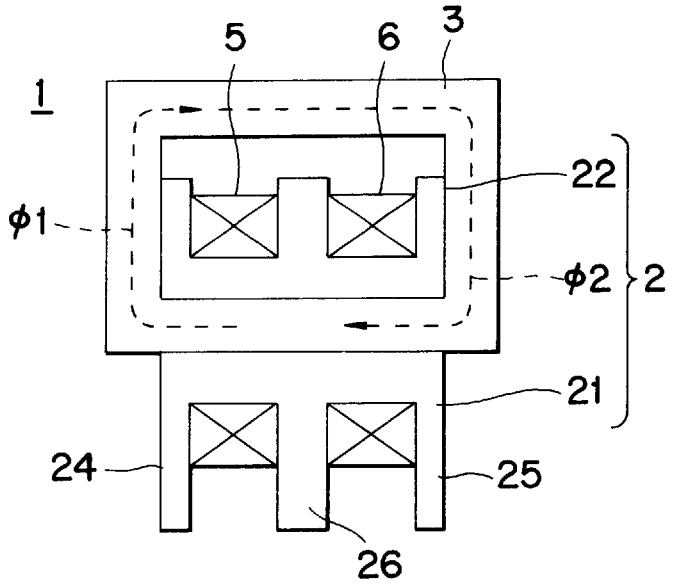

An explanation will now be given of the common-mode noise suppressing function of the choke coil 1 with reference to FIGS. 5A and 5B.

Figure 5B:
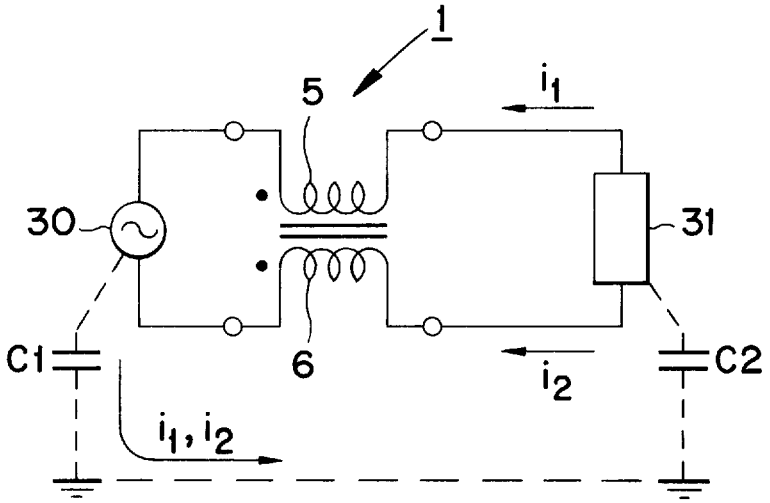

The choke coil 1 is electrically connected, as illustrated in FIG. 5B, to two signal lines disposed between a power source 30 and a load 31, such as electronic equipment. A first stray capacitance C1 is generated between the power source 30 and ground, while a second stray capacitance C2 is produced between the load 31 and ground. When common-mode noise currents $i_1$ and $i_2$ respectively flow in the two signal lines, as indicated by the arrows in FIG. 5B, two sets of magnetic flux $\phi 1$ and $\phi 2$ are efficiently generated, as shown in FIG. 5A, in the windings 5 and 6. The two sets of magnetic flux $\phi 1$ and $\phi 2$ are combined and are progressively attenuated while circulating in a closed magnetic path formed by the magnetic core 3. This is because the magnetic flux $\phi 1$ and $\phi 2$ is converted into thermal energy in the form of eddy current loss. As a consequence, the common-mode noise currents $i_1$ and $i_2$ are reduced.

The normal-mode noise suppressing function of the choke coil 1 will now be described with reference to FIGS. 6A and 6B.

Figure 6A:
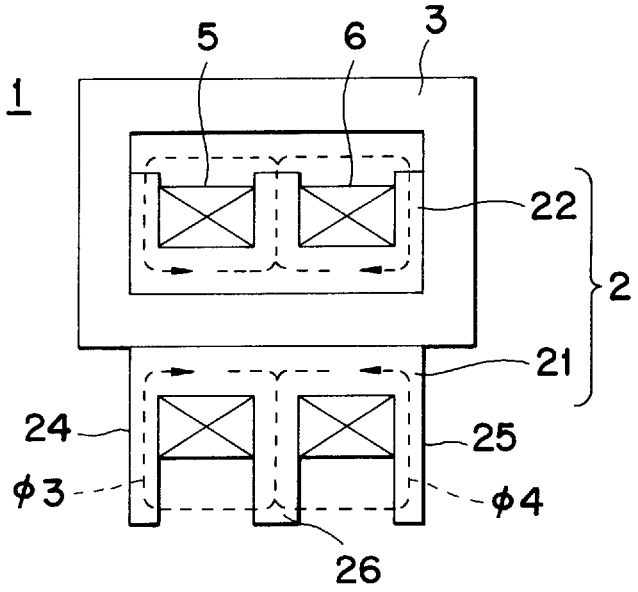
Figure 6B:
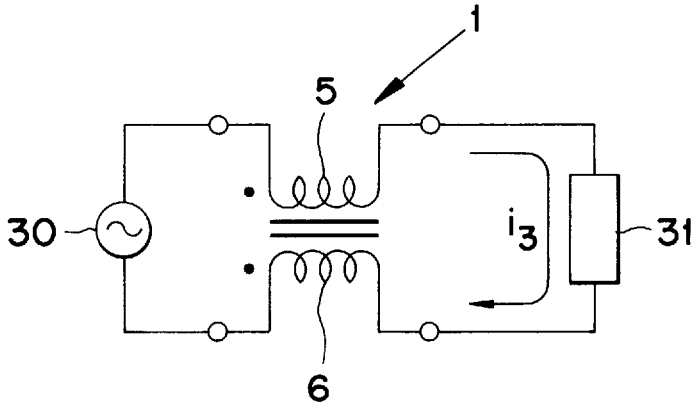

When a normal-mode noise current $i_3$ flows in the two signal lines, as indicated by the arrow in FIG. 6B, two sets of normal-mode magnetic flux $\phi 3$ and $\phi 4$ are efficiently generated, as shown in FIG. 6A, in the windings 5 and 6. The sets of magnetic flux $\phi 3$ and $\phi 4$ are converted into thermal energy in the form of eddy current loss and are accordingly progressively attenuated while circulating in the magnetic path formed in the magnetic bobbin 2 and a space between the bobbin 2 and the forward ends of the three flanges 24 through 26. Accordingly, the normal-mode noise current $i_3$ is reduced. This choke coil 1 can obviate the use of a lid member in the magnetic paths in which the normal-mode magnetic flux $\phi 3$ and $\phi 4$ circulates, thereby decreasing the number of parts and simplifying the assembly operation.

A detailed description will further be given of the state in which the normal-mode magnetic fluxes $\phi 3$ and $\phi 4$ are generated while referring to FIGS. 7A and 7B. FIGS. 7A and 7B illustrate computer-simulated analyses of the states in which normal-mode magnetic flux is generated. FIG. 7A is a diagram illustrating the magnetic-flux distribution of the choke coil 1 of this embodiment, while FIG. 7B is a diagram illustrating the magnetic-flux distribution of a known choke coil 42 which is constructed such that the height dimensions are the same in the upward and downward directions along the outer peripheral surfaces of the flange and are also set at a minimal dimension required for ensuring a distance from one end of one winding to one end of the other winding along the exposed surface of the flange. The simulation analyses reveal that normal-mode magnetic fluxes $\phi 3$ and $\phi 4$ are more efficiently generated in the choke coil 1 of this embodiment than in the conventional choke coil 42. It has also been validated that the choke coil 1 obtained a normal-mode inductance approximately 1.5 times as large as the known choke coil 42.

Figure 8:
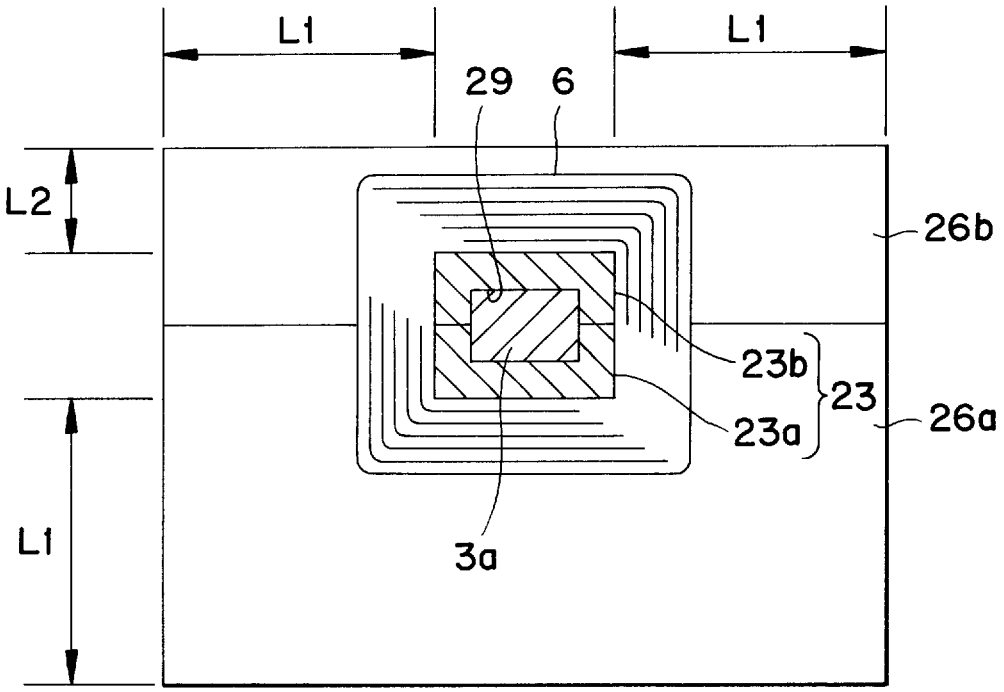
FIG. 8 is a cross-sectional view of a choke coil as a modification of the above-described embodiment of the present invention.

The choke coil of the present invention is not restricted to the aforedescribed embodiment, and may be variously changed within the spirit and scope of the invention. For instance, the flange of the bobbin may be formed in any shape as long as the heights of the flange are different between the upward and downward directions (or other directions) along the outer peripheral surfaces of the flange. For example, as illustrated in FIG. 8, the height of the flange may be determined as L2 in the upward direction, while the height of the flange may be set as L1 in the downward direction and leftward and rightward directions.

In the above-described embodiment, a pair of windings are separately wound with a partitioning flange interposed therebetween. However, this is not required, and a pair of windings may be bifilarly wound around the rod of the bobbin without providing a partitioning flange. Further, the magnetic core is a hollow-rectangular shape in this embodiment, but may be formed in another shape, for example, a shape of two rectangles side by side. The bobbin is a split type in this embodiment, but may be an integral type, in which case, the magnetic core is a split type, for example, combinations of the following types of cores: two L-shape cores, two U-shape cores, a U-shape core and an I-shape core, two E-shape cores, and an E-shape core and an I-shape core.

Additionally, in the foregoing embodiment, a lid member is not provided in the magnetic paths in which the normal-mode magnetic flux circulates. A lid member, however, may be disposed between the outer peripheral surfaces of the flanges, in which case, a normal-mode magnetic path may be formed between the lid member and the bobbin.

As is seen from the foregoing description, the present invention offers the following advantages. Since the heights of the flange are varied between the upward and downward directions along the outer peripheral surfaces of the flange, the normal-mode magnetic flux can be efficiently generated. It is thus possible to attain a choke coil having sufficient capability of suppressing both common-mode noise and normal-mode noise. Further, this choke coil can eliminate the use of a lid member in the magnetic paths in which the normal mode magnetic flux circulates, thereby decreasing the number of parts and simplifying the assembly operation.

While the invention has been described with reference to specific embodiments, modifications and variations of the invention may be constructed without departing from scope of the invention, which is defined in the following claims.

We claim:

1. A choke coil comprising:

a pair of windings;

a magnetic bobbin having a cylindrical rod and flanges extending away from said cylindrical rod about which said pair of windings are wound, the height of each of said flanges varying in radial directions wherein the height is measured from said cylindrical rod to the outer peripheral surfaces of said flanges; and a magnetic core, having one side which is in a hole in said cylindrical rod, for forming a closed magnetic path.

2. A choke coil according to claim 1, wherein each of said flanges have generally the same shape.

3. A choke coil according to claim 1, wherein said height of each of said flanges is the same in three out of four orthogonal directions in a plane, and different is said fourth direction.

4. A choke coil according to claim 3, wherein said height in said fourth direction is greater than the height in said three other directions.

5. A choke coil according to claim 3, wherein said height in said fourth direction is about twice the height in said three other directions.

6. A choke coil according to claim 3, wherein said height in said fourth direction is less than the height in said three other directions.

7. A choke coil according to claim 3, wherein said height in said fourth direction is one-half the height in said three other directions.

8. A choke coil according to claim 1, wherein said magnetic bobbin is a split-type bobbin and said magnetic core is an integral-type magnetic core.

9. A choke coil according to claim 1, wherein said magnetic bobbin is an integral bobbin and said magnetic core is one combination selected from the group consisting of: two L-shape cores, two U-shape cores, a U-shape core and an I-shape core, two E-shape cores, and an E-shape core and an I-shape core.

10. A choke coil according to claim 1, wherein said flanges include three rectangular-tabular flanges with two outer flanges disposed at ends of said cylindrical rod, and a central flange disposed at the center of said cylindrical rod.

11. A choke coil according to claim 1, wherein said flanges include two outer flanges disposed at ends of said cylindrical rod, and said pair of windings is a bifilarly wound pair of windings.

12. A choke coil according to claim 1, wherein said magnetic bobbin includes a material having a relative magnetic permeability ranging from greater than one to several dozen.

13. A choke coil according to claim 1, wherein said magnetic bobbin includes a material selected from the group consisting of: Ni-Zn or Mn-Zn ferrite powder and a resin binder, ferrite or amorphous coated with an insulating material, and ferrite or amorphous insert-molded into an insulating resin.

14. A choke coil according to claim 1, wherein said magnetic core includes a magnetic material having a relative magnetic permeability of several thousands.

15. A choke coil according to claim 1, wherein said magnetic core includes a magnetic material including one of the group consisting of ferrite or amorphous.

* * * * *